United States Patent [19]

Dahl

[11] Patent Number: 4,705,602

[45] Date of Patent: Nov. 10, 1987

[54] HYDRAULIC PRESSING SHOE WITH AN ADJUSTABLE CIRCUMFERENTIAL PRESS ZONE

[75] Inventor: Hans K. Dahl, Ravensburg, Fed. Rep. of Germany

[73] Assignee: Sulzer-Escher Wyss GmbH, Ravensburg, Fed. Rep. of Germany

[21] Appl. No.: 801,626

[22] Filed: Nov. 25, 1985

[30] Foreign Application Priority Data

Dec. 21, 1984 [CH] Switzerland ..... 6120/84

[51] Int. Cl.[4] ..... D21F 3/06; D21F 3/00

[52] U.S. Cl. ..... 162/358; 72/245; 100/118; 100/153; 162/361; 29/116 AD

[58] Field of Search ..... 162/358, 360.1, 361; 100/118, 153, 154; 29/113 AD, 116 AD; 72/241, 243, 245, 173

[56] References Cited

U.S. PATENT DOCUMENTS 4,228,571 10/1980 Biondetti ..... 29/116 AD
4,425,190 1/1984 Cronir ..... 162/358
4,503,765 3/1985 Schiel ..... 100/153
4,568,423 2/1986 Laapotti ..... 162/358

*Primary Examiner*—S. Leon Bashore
*Assistant Examiner*—K. M. Hastings
*Attorney, Agent, or Firm*—Werner W. Kleeman

[57] ABSTRACT

A pressing machine includes a roller and a pressing shoe which can be moved towards and away from the roller to exert pressure on the roller or on a material in a gap between the shoe and the roller. The shoe is mounted in a pressure chamber to which hydraulic pressure medium can be supplied to move the shoe. Upon movement towards the roller, the shoe applies pressure over a zone extending for a part of the circumference of the roller. Means is mounted on the pressing shoe for altering the length of this zone in the circumferential direction of the roller. To this end, the shoe may have two movable jaws which establish said zone, the jaws being movable by adjusting means over a cylindrical surface of said shoe which has substantially the same centre of curvature as the roller. The pressing shoe is particularly advantageous in a paper machine for dewatering a web of paper or for supporting the rollers of a rolling apparatus.

11 Claims, 5 Drawing Figures

HYDRAULIC PRESSING SHOE WITH AN ADJUSTABLE CIRCUMFERENTIAL PRESS ZONE

BACKGROUND OF THE INVENTION

The present invention broadly relates to a pressing shoe, and more particularly relates to a new and improved construction of a pressing shoe which is arranged to be pressed against the surface of a roller along a part of its circumference, the use of such a pressing shoe and a method of operating it.

Pressing shoes which can be pressed against the surface of a roller along a part of its circumference by at least one pressure chamber filled with hydraulic pressure medium, are used for example, as described in U.S. Pat. No. 3,974,026, granted Aug. 10, 1976, in the pressing part of a papermaking machine for dewatering a web of material, for example a web of paper, in which the web of material which is to be dewatered is passed together with a band which absorbs water, in a pressing gap between the pressing shoe and a rotating roller. Such pressing shoes may also be used for the support of the rollers in a rolling apparatus, as described in U.S. Pat. No. 4,041,752, granted Aug. 16, 1977.

In practice it is frequently necessary to be able to alter the amount of pressure applied by the pressing shoe, for example in order to be able to control the dewatering performance of a papermaking machine, as described in U.S. Pat. No. 4,074,624, granted Feb. 21, 1978, or in order to be able to regulate the lateral supporting force in a rolling apparatus, as disclosed for example in U.S. Pat. No. 4,149,397, granted Apr. 7, 1979. In order to control the amount of pressure applied, it has been proposed to alter the pressure of the hydraulic pressure medium in the pressure chamber by a suitable control or regulating arrangement. The range over which the amount of pressure applied can be controlled or regulated is, however, limited by the properties of the web of material which is to be pressed, or by the components which are used. The pressure of the pressure medium may not be increased to an unrestricted extent without exceeding the limit of stability of the materials which are to be pressed, e.g. of a web of paper, or of the components which are used, and without incurring the risk of damage to the material.

For certain applications, in particular for the dewatering of a web of paper, it is frequently desirable to be able to vary the amount of pressure applied and the duration of pressing independently of each other. The only free operational parameter which was available for this hitherto, namely the pressure, is not sufficient to satisfy these desiderata.

A change in the duration of pressing, with the speed remaining constant, has heretofore only been possible by changing the pressing shoe, for which purpose it is necessary to shut down the papermaking machine.

SUMMARY OF THE INVENTION

Therefore, with the foregoing in mind, it is a primary object of the present invention to provide a new and improved construction of a pressing shoe and a new and improved method of operating and using a pressing shoe which construction and methods do not exhibit the aforementioned drawbacks and shortcomings of the prior art.

Another and more specific object of the present invention aims at providing a new and improved construction of a pressing shoe which has an increased control and regulating range with regard to the amount of pressure applied.

An important further object of the present invention aims at providing a new and improved construction of a pressing shoe which permits changing the duration of pressing in the course of operation.

Another particularly significant object of the present invention is directed to a new and improved construction of a pressing shoe which renders possible altering the applied pressure as well as the duration of application of such pressure in the operative position of such pressing shoe.

Yet a further significant object of the present invention aims at providing a new and improved construction of a pressing shoe which is relatively simple in construction and design, extremely economical to manufacture, highly reliable in operation, not readily subject to breakdown or malfunction and requires a minimum of maintenance and servicing.

According to one aspect of the present invention there is provided in a pressing machine including a roller, pressing shoe means to define between said means and said roller a pressing gap to which pressure can be applied, said pressing shoe means comprising means defining at least one pressure chamber, means for connecting said pressure chamber to a source of hydraulic pressure medium, a pressing shoe mounted in said pressure chamber and arranged to be urged by said hydraulic pressure medium towards and away from said roller to apply pressure to said roller over a pressing zone extending along a part of the circumference of said roller, and means mounted on said pressing shoe for altering the length of said pressing zone in the circumferential direction of said roller.

According to another aspect of the present invention there is provided a method of applying pressure to a roller by means of a pressing shoe, comprising the steps of moving said shoe towards and away from said roller by means of a hydraulic pressure medium, whereby the pressing shoe applies pressure to said roller over a pressing zone extending along part of the circumference of said roller, and altering the length of said pressing zone in the circumferential direction of said roller.

It is also particularly advantageous if the pressing shoe has on its pressing surface as the means for altering the length of the pressing zone at least two jaws which are movable in the circumferential direction of the roller and which establish the pressing zone. It is desirable to construct the pressing shoe such that a pressure pocket of variable area is formed by two jaws on the pressing surface of the pressing shoe, which pocket communicates with the pressure chamber and is supplied via the latter with hydraulic pressure medium, so that the pressing shoe forms a hydrostatic support or bearing.

In a particularly expedient manner, a pressing shoe such as this can be constructed such that the jaws are able to slide on a cylindrical surface in the pressing shoe, the centre of curvature of which surface substantially coincides with the centre of curvature of the roller.

The inventive pressing shoe allows the maximum input pressure energy which is characterized by the pressure impulse and by the product of pressure and duration of pressing, to be optimally utilized. By the use of the pressing shoe, therefore, and depending upon the properties of a web of material which is subject to pressure in a pressing gap between the roller and the pressing shoe, at a constant pressure impulse, either the pressure can be increased in the case of webs of material which are sensitive to pressure, or the duration can be increased in the case of webs of material which are sensitive to time. The forces which have to be taken up by the components remain the same, although the pressure regulating range is increased. In the case of papermaking machines with changing types of paper, the pressure which is applied and the duration of pressing can be quickly and optimally adjusted when the types are changed.

Thus, with different operating speeds which are required by the process, the duration of pressing can be kept constant by a corresponding alteration of the length of the pressing zone.

BRIEF DESCRIPTION OF DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
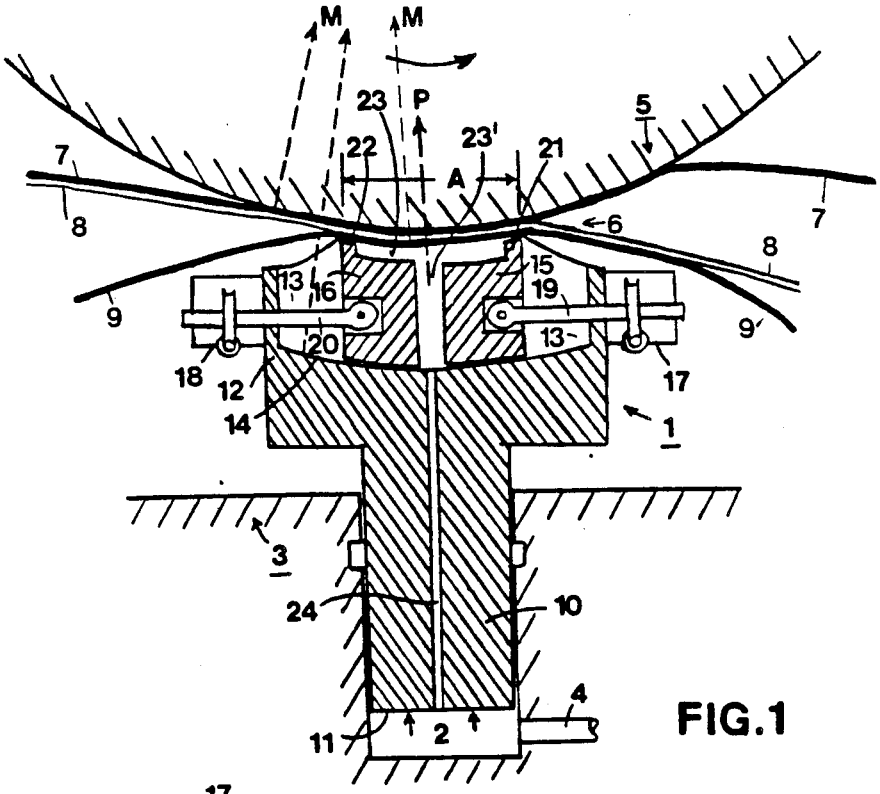
FIG. 1 is a longitudinal section through a a first exemplary embodiment of the inventive pressing shoe.
Figure 2:
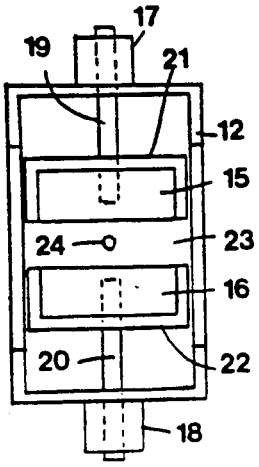
FIG. 2 is a plan view of the pressing surface of the pressing shoe shown in FIG. 1.

Describing now the drawings, it is to be understood that to simplify the showing thereof only enough of the structure of the pressing shoe has been illustrated therein as is needed to enable one skilled in the art to readily understand the underlying principles and concepts of this invention. Turning specificially to FIGS. 1 and 2 of the drawings, the pressing shoe 1 illustrated therein by way of example and not limitation, is 1 mounted in a wet-press of a papermaking machine. The pressing shoe 1 is mounted so as to be movable in a pressing directon P in one or more cylindrical or slot-like pressure chambers 2 formed in a support 3. Hydraulic pressure medium can be supplied to the pressure chamber 2 via a duct 4 to enable the pressing shoe 1 to be pressed with a corresponding pressure against a counter surface, which is shown as being the surface of a roller 5, over a pressing zone A extending along the circumference of the roller. This pressing zone A is formed by a surface S which is presented to the roller 5 by pressing shoe means including the pressing shoe 1 and defines a pressing gap 6 between the pressing shoe 1 and the roller 5.

A web of material to be dewatered, for example a web of paper 7, together with a band 8 which absorbs water, e.g. a felt band, are passed into the pressing gap 6 which is formed between the pressing shoe 1 and the roller 5 and along the pressing zone A whereby the web of paper 7 is dewatered whilst passing through the pressing gap 6. If necessary, further bands, e.g. a machine wire, may additionally be passed through the pressing gap 6. In addition, it is usually necessary to provide a covering 9, which is impervious to fluid, directly on the pressing surface of the pressing shoe 1. The covering 9 may be constructed as a flexible covering or as an endless band, which if necessary is guided over guide rolls (not illustrated), so as to ensure a sufficient flexibility and adaptability to the pressing surface of the pressing shoe 1 in the pressing gap 6.

The roller 5 may be constructed as a solid tube, as a suction roller, or as a deflection compensating roller, such as described for example in U.S. Pat. No. 3,802,044, granted Apr. 9, 1974. The roller 5 may also be constructed as a relatively flexible, tubular roller shell which is suitably supported in the interior. In the latter case, the shoe length must be displaced in the two rollers.

The pressing shoe 1 consists of a piston-shaped base part 10 having an underside 11. The underside 11 of the base part 10 supported by the pressure in the pressure chamber 2.

On a front face 12 of the pressing shoe 1, adjacent to the roller 5, a recess 13 is formed and is delimited on the inside by a cylindrical substantially sliding surface 14. Two jaws 15 and 16 are arranged in this recess 13 such that they are able to slide on the substantially cylindrical sliding surface 14. Two thrust motors 17 and 18 acting on two articulated thrust rods 19 and 20 are provided for moving the two jaws 15 and 16 in the circumferential direction of the substantially cylindrical sliding surface 14. In order to avoid tilting, it is expedient to control the thrust motors 17 and 18 such that the two jaws 15 and 16 move over the same path lengths or strokes in opposite directions.

It is particularly advantageous, if the jaws 15 and 16 are delimited toward the outside or outer edges by cross-pieces 21 and 22, which form between them a pressure pocket 23 at the pressing surface of the pressing shoe 1. This pressure pocket 23 communicates with the pressure chamber 2 via a gap 23' between the jaws 15 and 16 and a connecting bore 24 in the base part 10 of the pressing shoe 1, and is thereby supplied with pressure medium. The pressing shoe 1 consequently acts as a hydrostatic support element.

As distinguished from previously proposed hydrostatic support elements, as are disclosed for example in the aforesaid U.S. Pat. No. 3,802,044, the area and length of the pressure pocket 23 of the pressing shoe 1 according to the present invention are changeable and adjustable in the circumferential direction of the roller 5. Thus the length of the pressing zone A can be altered. This alteration of the length of the pressing zone A may also be undertaken during the operation of the papermaking machine, so that if necessary a control or regulation of the length of the pressing zone A can take place in dependence upon properties of the web of paper which have been measured in a suitable manner.

Figure 3:
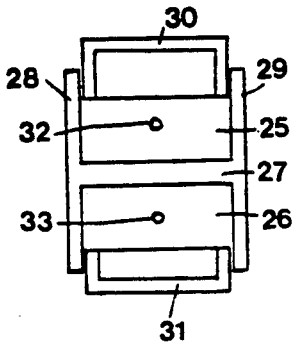
FIG. 3 is a plan view of a second exemplary embodiment of the inventive pressing shoe containing a plurality of pressure pockets.

In order to ensure a uniform pressing gap 6 along the pressing zone A, it is expedient to construct the substantially cylindrical sliding surfaces of the jaws 15 and 16 such that the centre of curvature thereof substantially coincides with the centre of curvature of the surface of the roller 5, and likewise with the center of curvature of the substantially cylindrical sliding surface 14 of the pressure pocket 23, or when using marginal cross-pieces 21, 22 and 27 as respectively shown in FIGS. 2 and 3, the centre of curvature of the cross-pieces 21,22 and 27, must coincide therewith.

Instead of effecting the displacement of the jaws 15 and 16 by means of the thrust rods 19 and 20 as described, other displacement mechanisms may also be used, e.g. spindles, toggles, hydraulic thrust motors or others.

FIG. 3 is a view similar to FIG. 2 showing a modification of the pressing shoe 1, in which a plurality of pressure pockets, two of which are indicated by reference numerals 25 and 26 are provided one behind the other in the circumferential direction of the substantially cylindrical sliding surface 14 shown in FIG. 1. The two pressure pockets 25 and 26 are separated from each other by the cross-piece 27, which is connected with lateral guideways 28 and 29 for jaws 30 and 31. The two pressure pockets 25 and 26 are connected by separate bores 32 and 33 to the same pressure chamber, which is supplied with pressure medium.

A pressure graduation which is directed to specific objectives, e.g. a rising pressure in the running direction, can be achieved with this modification if the area or size of the pressure pockets 25 and 26 is selected so as to be different, e.g. decreases in the running direction, or through an eccentric arrangement of the piston shaped base part 10 (cf. FIG. 1). Thereby an inclined position of the base part 10 with respect to the pressure chamber 2 (cf. FIG. 1) can be avoided through self-regulation owing to the restoring forces caused by different widths of the pressing gap 6, but if necessary also through a measurement of the inclination of the base part 10 and corresponding individual readjustment of the pressures in the two pressure pockets 25 and 26.

In an other variant, the base part 10 of the pressing shoe 1 is asymmetrically arranged with respect to the pressing zone A.

Figure 4:
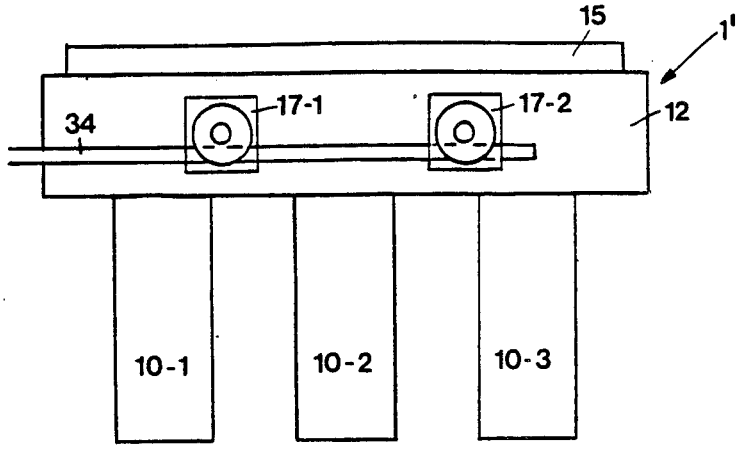
FIG. 4 is a side view of a third exemplary embodiment of the inventive pressing shoe with a plurality of piston-shaped base parts.
Figure 5:
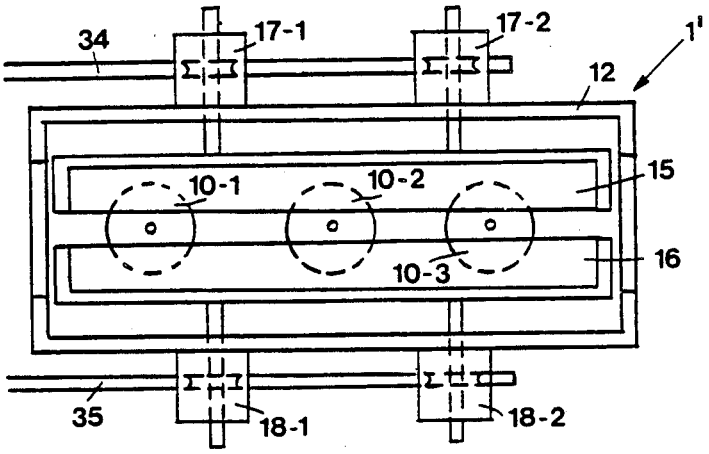
FIG. 5 is a plan view of the pressing shoe shown in FIG. 4.

It is noted that further modifications of the inventive pressing shoe 1 shown in FIG. 1 are possible. The pressing shoe 1' may, for example, be supported on a plurality of pressure chambers with separate piston-shaped base parts, such as shown for example in FIGS. 4 and 5. In this embodiment a pressing shoe 1' is shown extending over the entire width of the not-illustrated roller. A front part 12 of the pressing shoe 1' carries over its width a plurality of piston-shaped base parts 10-1, 10-2 and 10-3 which are movable in corresponding presure chambers in the pressing direction. A plurality of thrust motors 17-1, 17-2, 18-1 and 18-2 (cf. FIG. 5) are provided along the width of the pressing shoe 1', and the number of thrust motors may correspond to the number of base parts 10-1, 10-2 and 10-3, or may differ therefrom. In order to ensure a uniform thrust of the jaws 15 and 16 over the width of the pressing gap 6, the thrust motors 17-1 and 17-2 on the one side and 18-1 and 18-2 on the other side are actuatable by means of a common cross shaft 34 and 35, respectively.

The number of pressure pockets is not restricted to two. More partial pressure pockets may also be provided in the running direction, e.g. in addition to at least one part with a constant area, two parts with variable area, in which case all the parts are supplied through separate bores in the base parts. Also, the pressure pockets may be sub-divided in the axial direction into a plurality of partial pressure pockets, of instead of a single pressing shoe, a plurality of pressing shoes may be arranged adjacent to each other in the axial direction over the length of the roller.

While there are shown and described present preferred embodiments of the invention, it is to be distinctly understood that the invention is not limited thereto, but may be otherwise variously embodied and practiced within the scope of the following claims.

Accordingly, what I claim is:

1. In a pressing machine including a roller, pressing shoe means presenting to said roller a substantially concave surface structured to form a pressing zone extending along a part of the circumference of said roller in order to define between said pressing shoe means and said roller a pressing gap to which pressure can be applied, said pressing shoe means comprising means defining at least one pressure chamber, means for connecting said pressure chamber to a source of hydraulic pressure medium, said pressing shoe means including a pressing shoe mounted in said pressure chamber and defining an adjustable circumferential length determining the length of said pressing zone along said part of the circumference of said roller, said pressing shoe in its operative position being arranged to be urged by said hydraulic pressure medium towards and away from said roller to apply pressure to said roller over said pressing zone extending along said part of the circumference of said roller, and adjusting means mounted on said pressing shoe for adjusting said adjustable circumferential length of said pressing shoe in said operative position thereof and thereby the length of said pressing zone determined by said pressing shoe in the circumferential direction of said roller.

2. In a pressing machine including a roller, pressing shoe means presenting to said roller a substantially concave surface structured to form a pressing zone extending along a part of the circumference of said roller in order to define between said pressing shoe means and said roller a pressing gap to which pressure can be applied, said pressing shoe means comprising means defining at least one pressure chamber, means for connecting said pressure chamber to a source of hydraulic pressure medium, said pressing shoe means including a pressing shoe mounted in said pressure chamber and arranged to be urged by said pressure medium towards and away from said roller to apply pressure to said roller over said pressing zone extending along said part of the circumference of said roller, means mounted on said pressing shoe for altering the length of said pressing zone formed by said pressing shoe in the circumferential direction of said roller; and said means for altering the length of said pressing zone comprising at least two jaws movable in the circumferential direction of said roller to establish said pressing zone.

3. The pressing shoe means of claim 2, and said altering means including adjusting means to move said jaws.

4. The pressing shoe means of claim 3, wherein the pressing shoe is formed with a substantially cylindrical sliding surface and the jaws are slidingly movable along said substantially cylindrical sliding surface.

5. The pressing shoe means of claim 4, wherein said roller and said substantially cylindrical sliding surface have substantially coinciding centres of curvature.

6. The pressing shoe means of claim 2, wherein each of said jaws has an outer edge in the circumferential direction of said roller, said outer edges establishing the length of said pressing zone, and means establishing communication for the hydraulic pressure medium between said pressure chamber and the pressing zone between the outer edges of said jaws.

7. The pressing shoe means of claim 2, wherein each of said jaws has an outer edge in the circumferential direction of said roller, said outer edges establishing the length of said pressing zone, a cross-piece means dividing the pressing zone between said outer edges into a plurality of pressure pockets, and means establishing separate communication for the hydraulic pressure medium between said pressure chamber and each of said pressure pockets.

8. In a pressing machine including a roller, pressing shoe means presenting to said roller a substantially concave surface structured to form a pressing zone extending along a part of the circumference of said roller in order to define between said pressing shoe means and said roller a pressing gap to which pressure can be applied, said pressing shoe means comprising means defining a plurality of pressure chambers, a pressing shoe, base parts of said pressing shoe, each such part being mounted in a respective pressure chamber, means connecting each said pressure chamber to a source of hydraulic pressure medium, whereby said pressing shoe can be urged towards and away from said roller, at least two jaws mounted in said pressing shoe and movable in the circumferential direction of said roller to establish said pressing zone extending along said part of the circumference of said roller and via which pressing zone pressure can be applied to said roller upon movement of said pressing shoe towards said roller, and means for moving at least one of said jaws to alter the length of said pressing zone formed by said pressing shoe means in the circumferential direction of said roller.

9. In a papermaking machine, a pressing station comprising a roller, a pressing shoe, the pressing shoe presenting to said roller a substantially concave surface structured to form a pressing zone extending along a part of the circumference of said roller in order to define between said pressing shoe and said roller a pressing gap, means for passing a fibre web to be pressed through said pressing gap together with a band of another material, means defining at least one pressure chamber, means for connecting said pressure chamber to a source of hydraulic pressure medium, said pressing shoe being mounted in said pressure chamber and arranged to be urged by said hydraulic pressure medium towards and away from said roller to apply pressure to said fibre web in said pressing gap over said pressing zone extending along said part of the circumference of the roller, and means mounted on said pressing shoe for altering the length of said pressing zone formed by said pressing shoe in the circumferential direction of said roller.

10. The pressing station of claim 9, wherein said pressing shoe has a substantially cylindrical sliding surface with substantially the same centre of curvature as said roller, and wherein said altering comprise two jaws which are slidably movable on said substantially cylindrical sliding surface in the circumferential direction of said roller to establish said pressing zone, movement of said jaws altering the length of said pressing zone.

11. The pressing shoe means as defined in claim 7, wherein:

said pressure pockets are of different sizes.

* * * * *

UNITED STATES PATENT AND TRADEMARK OFFICE

CERTIFICATE OF CORRECTION

PATENT NO. : 4,705,602

DATED : November 10, 1987

INVENTOR(S) : HANS K. DAHL

It is certified that error appears in the above-identified patent and that said Letters Patent is hereby corrected as shown below:

Column 3, line 24, after "a" please delete "a" (third occurrence)

Column 3, line 46, after "is" please delete "1"

Column 4, line 19, after "10" please insert --is--

Column 4, line 23, please delete "cylindrical" and after "substantially" please insert --cylindrical--

Column 5, line 44, please delete "presure" and insert --pressure--

Column 5, line 62, after "pockets" please delete "of" and insert --or--

Signed and Sealed this

Twenty-fourth Day of May, 1988

*Attest:*

DONALD J. QUIGG

*Attesting Officer*

*Commissioner of Patents and Trademarks*